United States Patent [19]

Simm et al.

[11] 4,317,540

[45] Mar. 2, 1982

[54] SAFETY BURNER FOR PROJECTING MOLTEN METAL POWDERS

[75] Inventors: Wolfgang Simm, Lausanne; Hans-Theo Steine, Chavannes; Daniel Audemars, Echandens, all of Switzerland

[73] Assignee: Castolin S.A., Saint Sulpice, Switzerland

[21] Appl. No.: 177,759

[22] PCT Filed: Apr. 2, 1979

[86] PCT No.: PCT/CH79/00050

§ 371 Date: Nov. 29, 1979

§ 102(e) Date: Nov. 29, 1979

[87] PCT Pub. No.: WO79/00888

PCT Pub. Date: Nov. 1, 1979

[30] Foreign Application Priority Data

Apr. 6, 1978 [CH] Switzerland ..... 3694/78

[51] Int. Cl.[3] ..... B05B 7/20

[52] U.S. Cl. ..... 239/85; 141/18; 141/346; 222/153; 222/325

[58] Field of Search ..... 222/325, 153; 141/346, 141/347, 1 B, 2; 239/79, 85

[56] References Cited

U.S. PATENT DOCUMENTS

| | | | |
|---|---|---|---|
| 2,072,845 | 3/1937 | Benoit | 239/85 |
| 2,108,998 | 2/1938 | Schori | 239/85 |
| 2,741,508 | 4/1956 | Marantz | 239/81 |
| 2,813,750 | 11/1957 | Marantz | 239/85 |
| 2,961,335 | 11/1960 | Shepard | 239/85 X |
| 3,168,125 | 2/1965 | Rosell | 141/346 |

FOREIGN PATENT DOCUMENTS

| | | |
|---|---|---|
| 632644 | 6/1936 | Fed. Rep. of Germany . |
| 818895 | 10/1951 | Fed. Rep. of Germany . |
| 891481 | 9/1953 | Fed. Rep. of Germany . |
| 1206696 | 12/1965 | Fed. Rep. of Germany . |
| 2360747 | 6/1975 | Fed. Rep. of Germany . |

*Primary Examiner*—Andres Kashnikow

*Attorney, Agent, or Firm*—Hopgood, Calimafde, Kalil, Blaustein & Judlowe

[57] ABSTRACT

A safety burner for spraying metal powder in the molten state is provided comprising a burner body and a powder supply device formed of a carrier part firmly connected to the burner body and having an intermediate part removably attached to the carrier part, the intermediate part having means for detachably coupling a powder container thereto and also having a powder shutoff device cooperably associated therewith, the intermediate part and the carrier part being arranged one to the other such that the intermediate part can be removed from the carrier part only when the powder shutoff device is closed. The burner also includes gas flow conduits within it for conveying combustible gas and an oxidizing gas and powder-carrier gas therethrough. The burner body contains a first combustible gas-oxidizing gas injector and a second powder-carrier gas injector, the first injector being coupled to the combustible gas-oxidizing gas conduit and the second injector being coupled to the powder-carrier gas conduit. A gas-shutoff device is provided coupled to the gas-flow conduits.

9 Claims, 5 Drawing Figures

FIG. 3
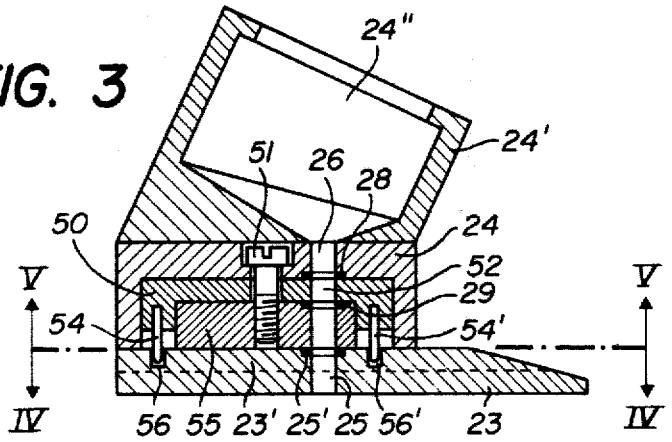
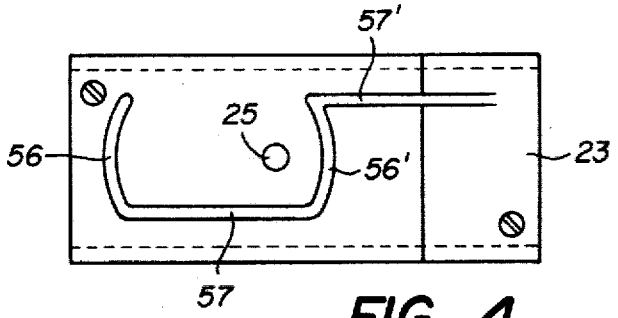
FIG. 4
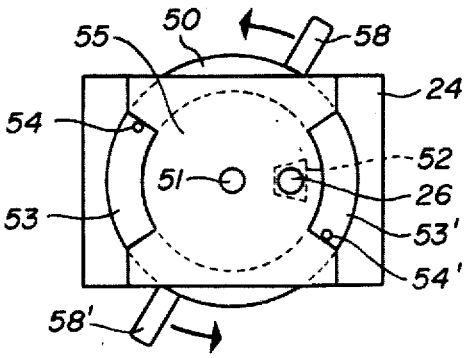
FIG. 5

SAFETY BURNER FOR PROJECTING MOLTEN METAL POWDERS

This invention consists of a safety burner for projecting molten metal powders with a powder supply device having a removable powder container and, in the body of the burner, conduits for the fuel gas and for the oxidation- and carrier gas, a fuel gas-oxidation gas injector, a powder-carrier gas injector and conduits for the fuel gas-oxidation-gas mixture and also for the powder carrier gas; there is a shutoff device in each conduit for the fuel gas and for the oxidation- and carrier gas.

The purpose of the invention is to make it easier to operate such a burner and to improve its efficiency, particularly as regards the supply of the powder and changing the powder container, also to achieve simple, effective adaptation to specific working conditions and to improve the burner's safety.

This is achieved, in a burner having a powder supply device with a carrier firmly connected to the burner and an intermediate part which can be removed from the carrier to accommodate the powder container and has a shutoff device for the powder, by arranging the shutoff device, the intermediate part and the carrier in such a way that the intermediate part can be removed from the carrier only when the shutoff device is closed.

Also, there is a pressure chamber, preferably in the carrier gas conduit between the shutoff device and the powder carrier gas injector. The powder carrier gas injector on the one hand, and the fuel gas-oxidation gas injector on the otherhand, are connected, preferably by screws, to the burner body in such a way that they can be exchanged and adjusted.

The shutoff device for the oxidation and carrier gas and for the fuel gas should, preferably, be controlled by the same device, arranged in such a way that it first interrupts the fuel gas and then the oxygen and carrier gas. The burner should also have a removable handle, in which the conduits for the fuel gas and for the oxygen and carrier gas are continued; each of these conduits has a non-return valve.

The invention is described in more detail below, with examples and with reference to the attached drawings.

FIG. 3 is a cross section of another version of the powder supply device of the burner in FIG. 1.

FIG. 4 is a top view of the carrier, FIG. 3 version.

FIG. 5 is a bottom view of the intermediate part of the powder supply device in FIG. 1.

Figures 1, 2:
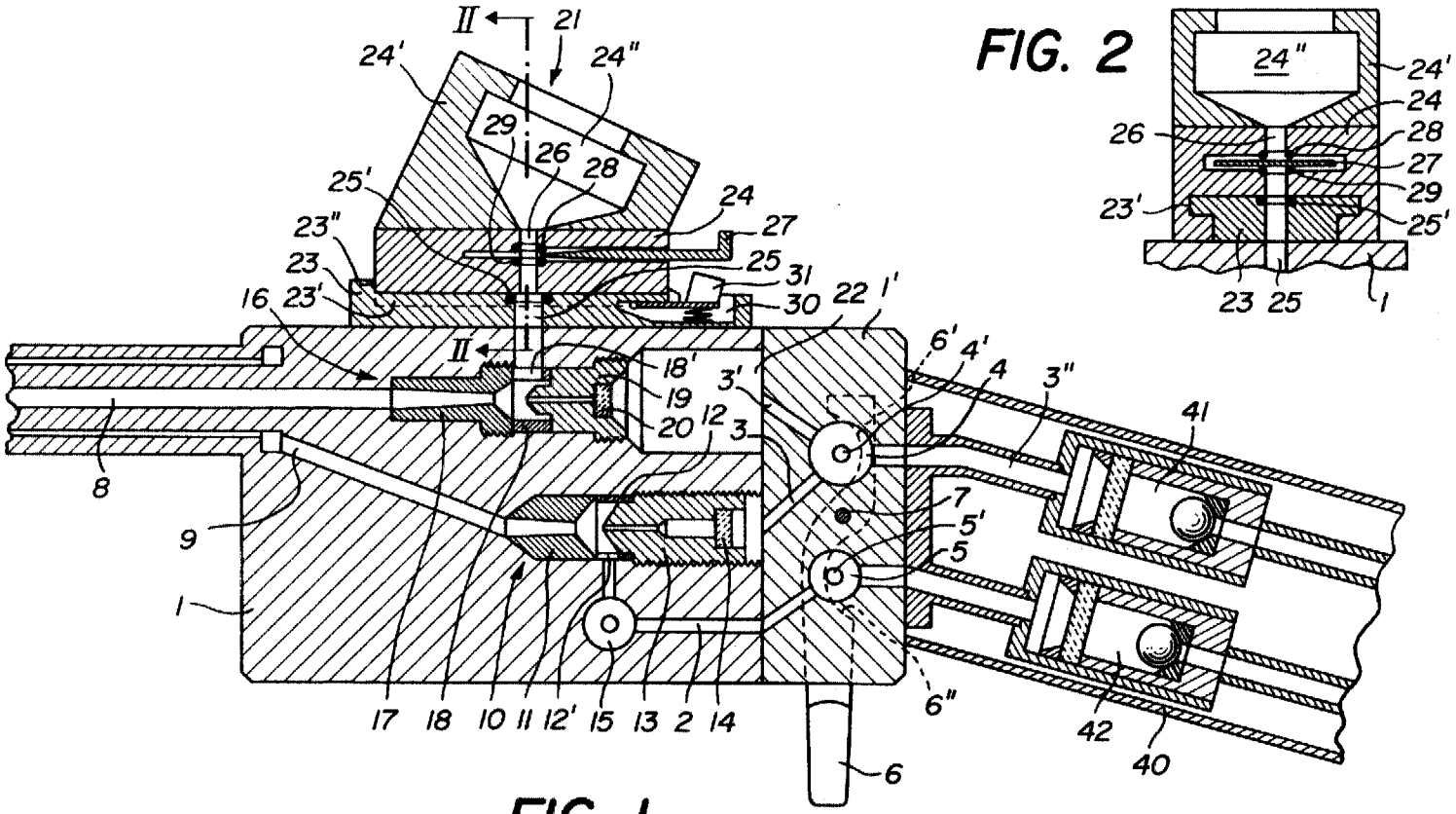
FIG. 1 is a simplified representation of one version of the invented burner, in longitudinal cross section.
FIG. 2 is a cross section through the powder supply device along the line II—II on FIG. 1.

The simplified representation in FIG. 1 of a burner for projecting molten metal powders has a two-part burner body, 1 and 1', in which conduits for the fuel gas and for the oxidation and carrier gas are arranged (labelled 2 for the fuel gas, 3 for the oxidation gas and 3' for the carrier gas). The oxidation and carrier gas is oxygen, supplied through a common part 3'' of conduits 3 and 3'. The conduit for each gas contains a shutoff device (4 and 5), operated by a common control 6. The shutoff devices 4 for the oxygen and 5 for the fuel gas shown on the diagram may be valves that can be operated at right angles to the drawing plane, while control device 6 can consist of a lever rotating around axis 7. Valves 4 and 5 can be switched off by suitable control areas 6' and 6'' of lever 6; these areas are made in such a way that they switch off valve 5 before valve 4, but they switch on first the oxygen and then the fuel gas. This is indicated diagrammatically in FIG. 1 by the different distance of control areas 6' and 6'' from the corresponding control elements 4' and 5' of the valves.

Burner body part 1 contains conduit 8 for the powder carrier gas, and conduit 9 for the oxygen-fuel gas mixture. The latter is produced in a first gas injector 10, which has a nozzle 11, a spacer ring 12 and an injector needle carrier 13 with filter 14. Spacer ring 12 has an opening 12', connected to conduit 2. In conduit 2, there is a control valve 15, to control the quantity of fuel gas supplied to injector 10. This control valve makes it possible to obtain reproducible flame characteristics (neutral, oxidizing, reducing).

All parts of injector 10 can be exchanged as arranged in burner body part 1; nozzle part 11 is fastened in place, spacer ring 12 may be of varying widths, and injector needle carrier 13 may have bores of various diameters and shapes, and, since it is threaded, can be screwed, or adjusted, on part 1. Filter 14 has the important function of keeping the injector clear of dust and other impurities. In part 1, in front of conduit 8 for the powder carrier gas, there is a second gas injector (16), also consisting of a nozzle 17, a spacer ring 18 and an injector needle carrier 19 with filter 20. The parts of this injector are as removable and adjustable as those of injector 10; spacer ring 18 has an opening 18', connected to powder supply device 21. By setting each of these parts as desired, the powder can be supplied in precise, repeatable manner. Injectors 10 and 16 are easily accessible for this purpose, once burner part 1 has been removed, through the corresponding bore holes.

In front of second gas injector 16, looking in the direction of the gas flow, part 1 has a pressure chamber 22, with a cross section considerably larger than that of conduit 3'. The important function of this pressure chamber is to cause an afterflow of gas, after valve 4 closes, through injector 16 and conduit 8, to purify the powder conduit and prevent gas back diffusion.

Conduits 8 and 9 end in the opening of the burner, not shown in the diagram, and made in the conventional manner.

Powder conduit 21 has a carrier part 23, firmly connected to the burner body; this carrier part has straight guides 23' on its sides.

An intermediate part 24 is arranged so that it can move along these guides, up to lug 23'' of the carrier part, in one direction. Carrier part 23 and intermediate part 24 each have a central bore, 25 and 26, which, in the position shown in FIG. 1, are arranged coaxially and are sealed off from the outside by an O-ring washer (25') at the joint between the fixed and the movable part. Bore 25 is connected to the powder conduit in burner body 1. In intermediate part 24, there is a slide bar (27) which can be moved along horizontally. The end of this slide bar is shaped to form a disk and, in one end position of the slide bar, intrudes between a pair of O-ring washers, 28 and 29, surrounding conduit 26, closing it off. The other end of slide bar 27 protrudes from the intermediate part and covers, in its open position, a recess 30 of carrier part 23. Recess 30 contains a stop knob 31 with elastic action, so that it protrudes, in its resting position, over the surface of carrier part 23, on which intermediate part 24 slides during its movement. Stop knob 31 is only accessible when slide bar 27 is in the closed position, i.e. when it is pushed into the intermediate part. When stop knob 31 is pressed, intermediate part 24 can be pushed over carrier part 23 and removed. When slide bar 27 is open, stop knob 31 prevents such removal and thus keeps the powder from flowing out through the open conduit 26.

Intermediate part 24 has input unit 24' for a powder container, not shown, the head of which can be placed into recess 24'' of the input unit. The input unit and intermediate parts 24 and 24' serve as closing device for the powder container, so that it can be removed from or replaced on the burner while closed.

The burner shown in FIG. 1 should have a handle 40 in which gas conduits 2 and 3'' continue and are connected to the corresponding flexible conductors at the end of the handle which is not shown in the diagram. Each of these extended conduits has a non-return valve, 41 and 42, thus providing an added safety feature for the burner. FIGS. 3, 4 and 5 show another version of the powder supply device. FIG. 3 is a cross section of the carrier part and the intermediate part, with the parts labelled as in FIG. 1. The corresponding powder conduits 25 and 26 in this version can be closed off by a disk, 50. This disk can be turned around screw bolt 51, and is located in intermediate part 24, with conduit 26 lying eccentric to the center of rotation of disk 50. Disk 50 has a window 52 which in one position of the disk (FIG. 3), opens powder conduit 26. Disk 50 also has cotter pins 54 and 54' at two diametrically opposite locations arranged parallel to the center of rotation of the disk and extruding above the bottom surface of intermediate part 24. The recess in intermediate part 24 in which disk 50 is mounted, is closed by a bottom part 55 which forms, together with intermediate part 24, two curved slits, 53 and 53', through which pass cotter pins 54 and 54'. Carrier part 23 has two curved slits, 56 and 56', which engage cotter pins 54 and 54'.

FIG. 4 is a top view of carrier part 23, in which the shape of slit 56 and 56' are visible in the gliding surface. The carrier part also has two straight slits, 57 and 57', with slit 57 connecting two ends of the two curved slits, and straight slit 57' proceeding from the other end of curved slit 56'. The two slits 57 and 57' run along the direction of movement of intermediate part 24, so that cotter pins 54 and 54' can be moved along slits 57 and 57' when disk 50 is arranged at the proper angle.

FIG. 5 is a bottom view of intermediate part 24, in which the curved slits 53 and 53' are visible, as well as the cotter pins 54 and 54' which pass through them. Disk 50 has two handles 58 and 58' which can turn it to the closed position. The position shown in FIG. 5 is that of the closed powder conduit, where cotter pin 54 lies on the closed side of the curved slit 56. By turning the disk in the direction of the arrow, pins 54 and 54' are moved to the ends of the curved slits 56 and 56', to which the straight slits 57 and 57' are connected. In this position, window 52 of disk 50 is turned out of the open position (shown in FIG. 5 by a dashed line), thus locking powder conduit 26. Intermediate part 24 can now be removed by sliding it along the sliding surface of carrier part 23.

This burner is thus characterized by special ease of operation and safety in servicing and use. The powder supply device in particular makes it easy to exchange the powder quickly without danger of dirtying the burner, while the pressure chamber cleanses the injector when it is switched off quickly by the control lever. Coupling of the gas valves in another, important improvement of this burner, for the flame characteristic can be easily and clearly adjusted by a single control valve. In this connection, the exchangeability of the injectors and the possibility of setting their output characteristic by exchangeable parts is very important in actual operation.

I claim:

1. A safety burner for spraying metal powder in the molten state which comprises, a burner body, a powder supply device comprising a carrier part firmly connected to said burner body and having an intermediate part removably attached to the carrier part, said intermediate part having means for detachably coupling a powder container thereto and also having a powder shutoff means cooperably associated therewith, said intermediate part and said carrier part being arranged one to the other such that the intermediate part can be removed from the carrier part only when the powder shutoff means is closed, gas-flow conduits within said burner body for conveying combustible gas, and an oxidizing gas and powder-carrier gas therethrough, a first combustible gas-oxidizing gas injector and a second powder-carrier gas injector located in said burner body, said first injector being coupled to the combustible gas-oxidizing gas conduit and said second injector being coupled to the powder-carrier gas conduit, and gas-shutoff means coupled to said conduits feeding each of said first and second injectors.

2. A safety burner for spraying metal powder in the molten state which comprises, a burner body, a powder supply device coupled to said burner body and being operably positioned in powder discharge relationship thereto via a powder flow conduit entering the interior of said body, said powder supply device comprising a carrier part firmly connected to said burner body and having an intermediate part removably attached and slidably mounted with respect to said carrier part and having means for detachably coupling a powder container thereto, said intermediate part being guided to be displaceable along a sliding direction, a powder shutoff means cooperably associated with said intermediate part, said powder shutoff means being arranged so that the intermediate part can be separated from said carrier part only when said powder shutoff means is closed, gas conduits in said burner body for conducting combustible gas and also for conducting an oxidizing and a powder-carrier-gas therethrough, a first gas injector located within said burner body for receiving combustible and oxidizing gas from said gas conduits and provide a mixture thereof, a second gas injector within said burner body for receiving metal powder from said powder supply device via said powder flow conduit and for receiving said powder-carrier gas, gas-flow shutoff means coupled respectively to each of said combustible gas conduit and said powder-carrier-gas and oxidizing gas conduit, and control means for actuating said gas-flow shutoff means.

3. The safety burner according to claim 2,
wherein said powder shutoff means is a slide bar,
wherein said carrier part has a resilient locking mechanism arranged to prevent, in the rest position, the intermediate part from being slidably displaced from the position corresponding to the powder supply device operating position, and
wherein the slide bar has a part which when the slide bar is in its open position hinders the resilient locking mechanism from being displaced from its rest position.

4. The safety burner according to claim 2,
wherein said powder shutoff means comprises a rotating shutoff disk which supports two diametrically disposed cotter pins,
each passing through a curved slit in the intermediate part and projecting from a sliding surface of the intermediate part supported by a corresponding sliding surface of said carrier part,
wherein the corresponding sliding surface of the carrier part is provided with two curved slits opposite to said curved slits in the intermediate part, including two straight slits disposed in the sliding direction of the intermediate part,
one of said straight slits connecting two ends of said two curved slits and the other of said straight slits proceeding from another end of one of said curved slits such that the cotter pins during rotation of the disk from the open to the closed position of the powder shutoff device are caused to slide along the curved slits of the carrier part and each arrive at one end of the straight slits of the carrier part, thereby allowing the intermediate part to slidably move along said carrier part.

5. The safety burner according to claim 2, wherein the second gas injector has a pressure chamber located between the powder-carrier gas conduit and the gas injector substantially wider than the size of said conduit.

6. The safety burner according to claim 2, wherein the second gas injector has an exchangeably adjustable injector needle carrier located coaxially rearwardly thereof separated by a removable spacer ring defining a powder-receiving cavity, said spacer ring having an opening through which the powder enters said cavity during discharge thereof from said powder supply device.

7. The safety burner of claim 2, wherein said gas-flow shutoff means coupled respectively to each of said combustible gas conduit and said powder-carrier and oxidizing gas conduit is arranged relative to said actuating control means such that when said control means is actuated, it interrupts the flow of the combustible gas and thereafter the flow of the oxidizing gas.

8. The safety burner of claim 7, wherein the gas-flow shutoff means is a valve coupled to the combustible gas conduit and a valve coupled to the powder-carrier gas and oxidizing gas conduit and wherein said actuating control means is a pivotally connected lever which is disposed in an angular contactable position relative to said valves, such that during angular displacement of said pivotally mounted lever, the opening and closing of the valves and vice versa differ in sequence.

9. The safety burner of claim 2, wherein the burner body is removably coupled to a handle through which the gas-flow conduits pass and in which each of the gas-flow conduits in said handle is coupled to a non-return valve.

* * * * *